US007955102B2

(12) United States Patent
Santos

(10) Patent No.: US 7,955,102 B2
(45) Date of Patent: Jun. 7, 2011

(54) LOCKING SYSTEM TO KEEP MOVABLE CONTACTS APART FROM FIXED CONTACTS OF A SHORT CIRCUIT

(76) Inventor: Eduardo Pedrosa Santos, Atibaia (BR)

( * ) Notice: Subject to any disclaimer, the term of this patent is extended or adjusted under 35 U.S.C. 154(b) by 0 days.

(21) Appl. No.: 12/298,465

(22) PCT Filed: Mar. 15, 2007

(86) PCT No.: PCT/BR2007/000062

§ 371 (c)(1),
(2), (4) Date: Apr. 7, 2009

(87) PCT Pub. No.: WO2007/121453

PCT Pub. Date: Nov. 1, 2007

(65) Prior Publication Data

US 2009/0186504 A1 Jul. 23, 2009

(30) Foreign Application Priority Data

Apr. 24, 2006 (BR) ..... 0601439

(51) Int. Cl.
*H01R 29/00* (2006.01)

(52) U.S. Cl. ..... 439/188

(58) Field of Classification Search ..... 439/188, 439/108; 361/35, 15
See application file for complete search history.

(56) References Cited

U.S. PATENT DOCUMENTS 3,322,964 A * 5/1967 Walter et al. ..... 307/66
3,512,043 A * 5/1970 Werner et al. ..... 361/35
(Continued)

FOREIGN PATENT DOCUMENTS

DE 4444551 A1 6/1996
(Continued)

OTHER PUBLICATIONS

English Translation of EP 055653 A1 (Bernhard Guglhor Prazisionsteile GMBH & Co) Aug. 18, 1993.

(Continued)

*Primary Examiner* — Chandrika Prasad
(74) *Attorney, Agent, or Firm* — McKee, Voorhees & Sease, P.L.C.

(57) ABSTRACT

Electrical circuit quick connection and disconnection system with automatic short circuit of current transformer secondaries and similar devices, consists of a multipole plug (6) and receptacle (11) system with automatic short-circuit capacity between the poles (7, 12) upon initiation of disconnection between the plug (6) and the receptacle (11), without incurring in the temporary opening of the circuit, for application in current transformer (3) secondary circuits (3B) and other applications requiring the same characteristics. The system is equipped with a number N of paired poles (7, 12), being that each pair of poles (7, 12) is connected to a CT (3) secondary (3B), therefore handling the connection of N CT (3) secondaries (3B). Each pair of poles (J, 12) is equipped with a system that, under normal conditions of use, that is, with the plug (6) and the receptacle (11) connected, allows the normal passage of current from the CT (3) secondary (3B) to the load (14) connected to the latter, without short-circuiting the CT (3) secondary (3B).

14 Claims, 3 Drawing Sheets

U.S. PATENT DOCUMENTS

Figure 1:
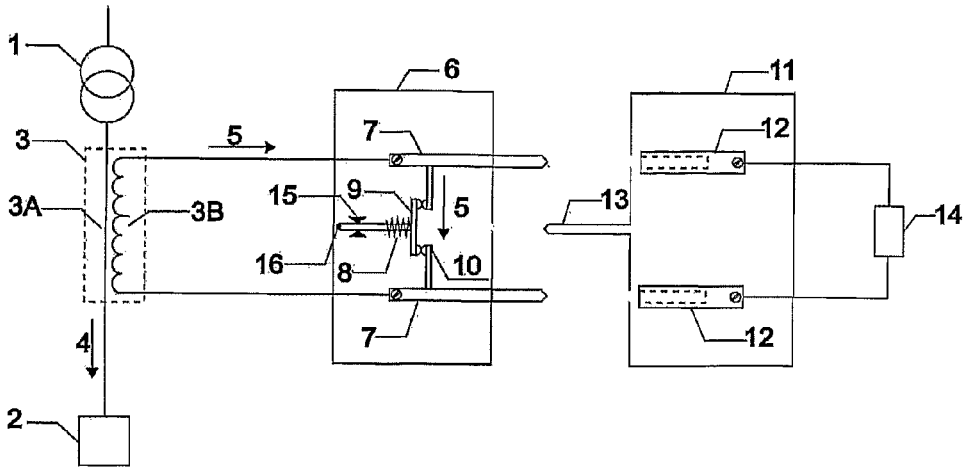

| | | | | | |
|---|---|---|---|---|---|
| 4,871,323 | A | * | 10/1989 | Ohsumi | 439/188 |
| 5,601,442 | A | | 2/1997 | Harting et al. | |
| 5,834,919 | A | * | 11/1998 | Liu | 320/111 |
| 5,946,180 | A | * | 8/1999 | Simpson | 361/93.3 |
| 7,354,287 | B1 | * | 4/2008 | Hickam | 439/188 |
| 2008/0102672 | A1 | * | 5/2008 | Hickam | 439/188 |

FOREIGN PATENT DOCUMENTS

| | | | |
|---|---|---|---|
| EP | 0 555 653 | A1 | 8/1993 |
| JP | 09-035822 | A | 2/1997 |

OTHER PUBLICATIONS

English Translation of DE 4444551 A1 (Wago Verwaltungsgesellschaft MBH) Jun. 5, 1996.

Search Report for co-pending PCT/BR2007/000062 listing relevant art cited by the International Searching Authority.

English Translation of EP 055653 A1 (Bernhard Guglhor Prazisionsteile GMBH & Co) Aug. 18, 1993.

English Translation of DE 4444551 A1 (Wago Verwaltungsgesellschaft MBH) Jun. 5, 1996.

* cited by examiner

LOCKING SYSTEM TO KEEP MOVABLE CONTACTS APART FROM FIXED CONTACTS OF A SHORT CIRCUIT

BRIEF INTRODUCTION

The present request for Invention patent deals with an inedited "ELECTRICAL CIRCUIT QUICK CONNECTION AND DISCONNECTION SYSTEM WITH AUTOMATIC SHORT CIRCUIT OF CURRENT TRANSFORMER SECONDARIES AND SIMILAR DEVICES"; more specifically of a multipole plug and receptacle system with automatic short circuit capacity between poles upon initiating the disconnection between the plug and receptacle, without incurring in the temporary opening of the circuit, for application in current transformer secondary circuits and other applications requiring the same characteristics.

BRIEF BACKGROUND

Current transformers, also called CTs, are devices used in electrical installations to convert the magnitude of an alternate electric current, typically stepping down the current present in its primary circuit, which may of the order of tens, hundreds or thousands of amperes (A), to values in the order of 5 A in its secondary circuit. For such, the current transformer is connected in series with a load, so that the current consumed by said load crosses its primary circuit, while in the secondary circuit devices are connected for the functions of load current measurement, load protection against overcurrents, etc.

Constructively speaking, current transformers can be independent equipment or they can be associated with other power equipment, installed on transformer bushings, circuit breakers, etc. In this case, the wiring coming from the current transformer secondaries is directed to a crossover panel located on the equipment body, together with cables coming from other auxiliary devices. All the auxiliary devices' wiring is connected on this panel by means of crossover terminals; these devices include:

CT secondaries;
Contacts for signaling;
Contacts for alarms;
Contacts for equipment disconnection;
Amongst others.

Current transformers are equipped with a set of coils between their primary and secondary circuits; this set of coils, while stepping down the value of the electric current, increases the voltage present in the secondary if it is not connected to a low impedance circuit. In fact, when the current transformer secondary is kept open and a current is applied to its primary circuit, the voltage produced between its two secondary terminals can reach values large enough to break the isolation of the circuits connected to the secondary, with a safety risk to operators and possible damage to the equipment. To reduce this risk, the crossover terminals used to connect the current transformer secondaries allow these secondaries to be short-circuited when necessary to disconnect the load associated to them, avoiding the development of elevated voltages.

STATE OF THE ART

As already commented, if the current transformer secondaries are maintained open, the high voltages therein developed may produce serious accidents, with the risk of death and damage to the equipment. To attenuate this risk, crossover terminals are used, allowing to short-circuit the current transformer secondaries before disconnecting the load cables connected to said secondaries; this is performed, for example, by screwing a conductive bar on the upper part of the terminals. As can be observed, this maneuver requires extreme care on the part of the operators, since, if the sequence of operations is inverted (disconnection of the cables before installation of the short-circuit) the consequences may be extremely serious. This system possesses, therefore, the following inconveniences:

Greater possibility of human error during the procedure;
Requires that the electric power concessionaires adopt, as a norm, the non-operation of current transformer circuits when the equipment is energized, forcing them to disconnect the equipment to perform simple tasks that could be conducted while the equipment was energized, if said risk did not exist;
The interruptions for repairs result in elevated costs and fines applied by the sector's regulatory agency, even in the case of programmed disconnections; this also generates a 'break' in company billings.

For increased ease of installation, operation and maintenance, there is a trend to substitute the crossover terminals that exist on the equipment panel for a system based on multipole plugs and receptacles as requested in patent request PI-0503641-0. Despite the advantages presented by this system, in the case of CT secondaries, its use is made impossible due to the increased risk of opening of the secondaries in the case of an accidental disconnection of the receptacles while the equipment is energized. Therefore, it was chosen to use a system based on multipole plugs and receptacles for all the auxiliary circuits, with the exception of the CT secondaries, which continues to use the crossover terminal system, with its inherent disadvantages.

THE NEW INVENTION

The new invention consists of a multipole plug and receptacle system with automatic short-circuit capacity between poles upon initiating the disconnection between plug and receptacle, without incurring in the temporary opening of the circuit, for application in current transformer secondary circuits and other applications requiring the same characteristics.

The system is equipped with a number N of paired poles, with each pair of poles connected to a CT secondary, therefore allowing the connection of N CT secondaries. Each pair of poles is equipped with a system that, under normal usage conditions of connected plug and receptacle, allows the normal passage of current from the CT secondary to the load connected to the same, without short-circuiting the CT secondary.

Upon initiating the mechanical disconnection between the plug and the receptacle, with the electric connection between plug and receptacle still present, the CT secondary is automatically short-circuited before the circuit is interrupted. After this, continuing with the mechanical disconnection, the electric connection between plug and receptacle is interrupted, however without the risk of the development of dangerous voltages in the CT secondary, since it has already been short-circuited.

ADVANTAGES OF THE NEW INVENTION

Elimination of the manual process to short-circuit the CT secondaries that, as already described, requires extreme care on the part of the operator to correctly sequence the required maneuvers. Consequently, the risk of accidents caused by human error is eliminated, along with the consequences such as: risk of death and damage to the equipment involved;

Eliminates the need to disconnect equipment for the performance of simple services that can now be performed while the equipment is energized, due to the elimination of the possibility of the risk of accidental opening of the CT secondaries;

Elimination of the costs related to the fines referent to the interruptions in supply as well as the break in billings associated to these interruptions;

Enables the substitution of the crossover terminals existing on the equipment panel for a system based on multipole plugs and receptacles even in the case of CT secondaries, upon disconnection between plug and receptacle;

Enables the standardization of the auxiliary circuit connection system of power transformers, high voltage circuit breakers and others, using multipole plugs and receptacles for all the circuits, without exception; with a reduction in manufacturing, operating and maintenance costs associated to said standardization.

DETAILED DESCRIPTION

Figure 2:
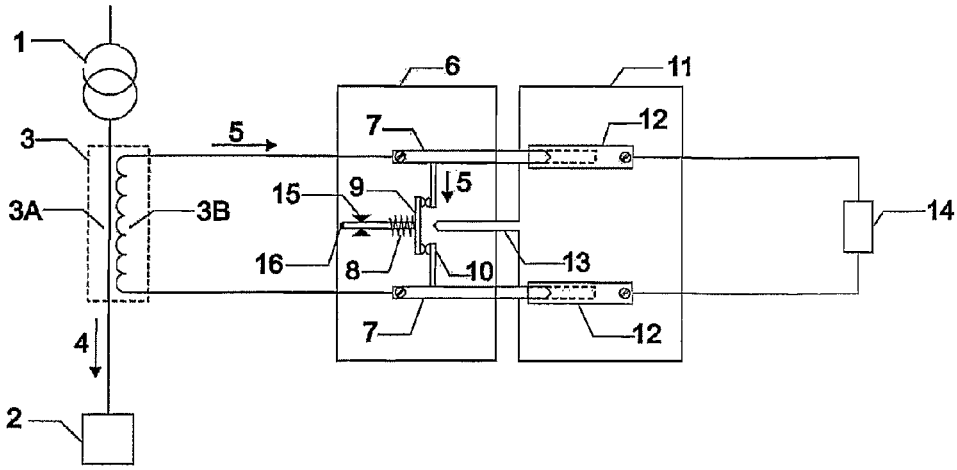
Figure 3:
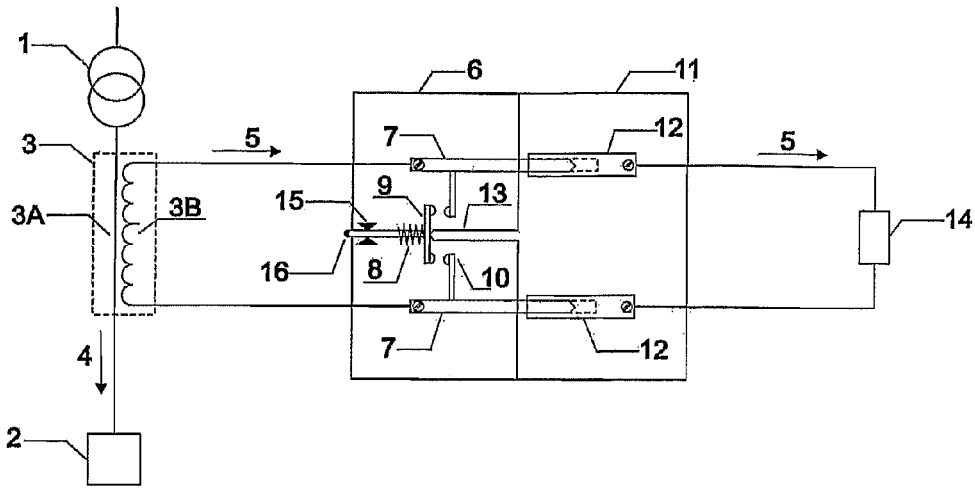
Figure 4:
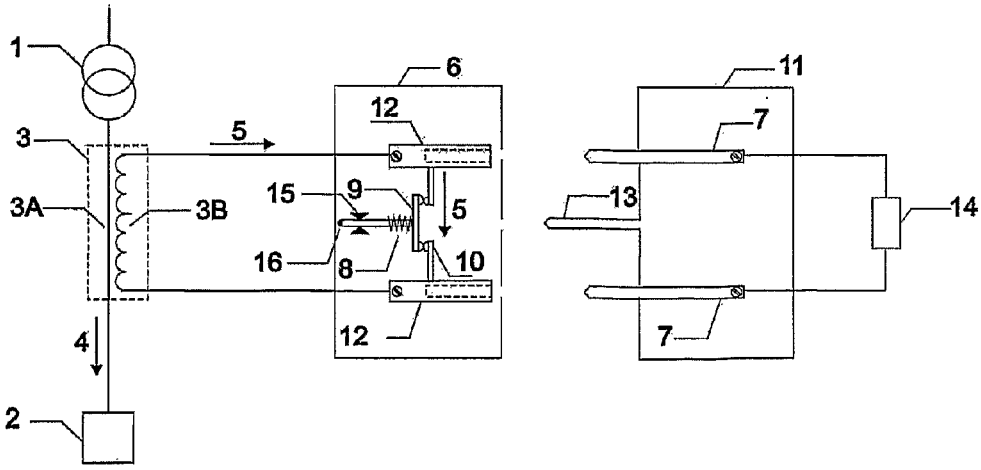

The following is a technical explanation of the invention, using as a base the following drawings:

FIG. 1: Schematic drawing of the mechanically and electrically disconnected plug and receptacle, showing short-circuit contacts assembled next to the male poles;

FIG. 2: Schematic drawing of the partially mechanically and electrically connected plug and receptacle, showing short-circuit contacts assembled next to the male poles;

FIG. 3: Schematic drawing of the mechanically and electrically connected plug and receptacle, showing short-circuit contacts assembled next to the male poles;

FIG. 4: Schematic drawing of the mechanically and electrically disconnected plug and receptacle, showing short-circuit contacts assembled next to the female poles.

FIG: 5: Schematic showing drawing of the mechanically and electrically disconnected plug and receptacle showing the locking system locking out the automatic short-circuit capacity.

The "ELECTRICAL CIRCUIT QUICK CONNECTION AND DISCONNECTION SYSTEM WITH AUTOMATIC SHORT CIRCUIT OF CURRENT TRANSFORMER SECONDARIES AND SIMILAR DEVICES", object of this Invention patent request, consists of a multipole plug (6) and receptacle (11) system with capacity of automatic short-circuit between poles (7, 12) upon initiating the disconnection between plug (6) and receptacle (11), without incurring in the temporary opening of the circuit, for application on current transformer (3) secondary circuits (3B) and other applications requiring the same characteristics.

The system is equipped with a number N of paired poles (7, 12), with each pair of poles (7, 12) connected to a CT (3) secondary (3B), capable therefore of handling N CT (3B) secondaries. Each pair of poles (7, 12) is equipped with a system that, under normal conditions of use, that is, with the plug (6) and receptacle (11) connected, allows the normal passage of current from the CT (3) secondary (3B) to the load (14) connected to it, without short-circuiting the CT (3) secondary (3B).

Upon initiating the mechanical disconnection between the plug (6) and the receptacle (11), with, however, the electrical connection between the plug (6) and the receptacle (11) still present, the CT (3) secondary (3B) is automatically short-circuited before the circuit is actually interrupted. Following this, continuing with the mechanical disconnection, the electrical connection between the plug (6) and the receptacle (11) is interrupted, however without the risk of developing dangerous voltages in the CT (3) secondary (3B), since it has already been previously short-circuited.

More specifically, the system proposed in FIG. 1, which shows the load current (4) coming from the power equipment (1) crossing the current transformer (3) primary (3A) in direction of the load (2). This generates a current (5) in the CT (3) secondary (3B). The CT (3) secondary (3B) is connected to a pair of male poles (7) on the plug (6). Since the plug (6) is mechanically disconnected from the receptacle (11), the spring (8) pushes the moveable contact (9) against the fixed contact (10), maintaining, in this way, the CT (3) secondary (3B) short-circuited even with the plug (6) and receptacle (11) mechanically and electrically disconnected.

FIG. 2, on the other hand, demonstrates the moment at which the mechanical connection between the plug (6) and the receptacle (11) is initiated, although still incomplete, at which the male poles (7) of the plug (6) have already established electrical contact with the female poles (12) of the receptacle (11), however the CT (3) secondary (3B) current (5) is not yet circulating in the direction of the load (14) because the moveable contact (9) is still touching the fixed contact (10) due to the strength of the spring (8). The visual indicator (16) of open short-circuit contacts still remains hidden inside the plug (6).

Upon completion of the mechanical connection between the plug (6) and the receptacle (11), as demonstrated in FIG. 3, which shows the male poles (7) of the plug (6) completely inserted and electrically connected to the female poles (12) of the receptacle (11) and the receptacle's (11) pin (13) pushing the moveable contact (9) so as to separate it from the fixed contact (10), overcoming the tension of the spring (8). So being, the CT's (3) secondary (3B) current (5) circulates in direction of the load (14), since the mechanical and electrical connection of the plug (6) with the receptacle (11) is complete. In this situation, the visual indicator (16) of open short-circuit contacts now appears on the outer part of the plug (6), indicating that the CT (3) secondary (3B) is no longer short-circuited.

Performing the inverse process, in other words, disconnecting the plug (6) from the receptacle (11), we return to the condition shown in FIG. 2, in which the mechanical disconnection has been initiated, however the male poles (7) and female poles (12) are still electrically connected. In this situation, the pin (13), fixed in the receptacle (11) has already been removed from the plug (6), so that the CT (3) secondary (3B) has already been short-circuited by the moveable contact (9) that touches the fixed contact (10), pushed by the strength of the spring (8). The visual indicator (16) of open short-circuit contacts returns to the inside of the plug (6).

Following this, upon completion of the disconnection between the plug (6) and the receptacle (11), as shown in FIG. 1, the CT (3) secondary (3B) is short-circuited, although the male poles (7) and female poles (12) are electrically disconnected and the secondary current (5) no longer crosses the load (14), allowing, for example, that maintenance services be freely performed, even though the power equipment (1) remains energized and in operation.

In addition to the configurations shown in the previous figures in which the fixed (10) and moveable (9) short circuit contacts are assembled next to the male poles (7), the constructive arrangement in which the fixed (10) and moveable (9) contacts are assembled next to the female poles (12) is also possible, as shown in FIG. 4.

Figure 5:
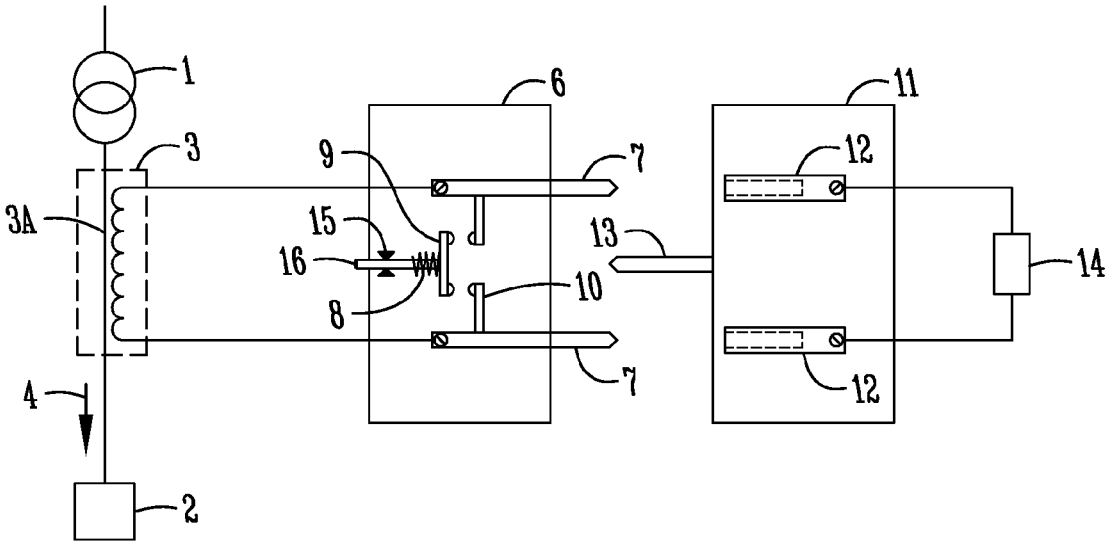

The plug (6) and receptacle (11) system herein described can also be applied in situations in which the automatic short-circuit between poles is not necessary or desirable, and, for this reason, the system is equipped with a locking system (15) capable of maintaining the moveable short-circuit contact (9) separated from the fixed short-circuit contact (10), even if the plug (6) and receptacle (11) are not connected. As shown in FIG. 5, in situations in which said locking system (15) is being used, the indicator (16) of open short-circuit contacts remains permanently visible outside the plug, warning the user about this condition.

The invention claimed is:

1. An electrical circuit quick connection and disconnection system with automatic short circuit of current transformer (CT) secondaries comprising a multipole plug (6) and receptacle (11) system for connecting a load (14) to a current transformer secondary circuit (3B) with automatic short circuit capacity between poles (7,12) upon initiating a disconnection between the plug (6) and receptacle (11), without incurring any temporary opening of the circuit (3B), further comprising a pair of male (7) or female (12) poles to which the CT (3) secondary (3B) is connected being electrically connected to a series of fixed contacts (10) that can be short circuited by a series of moveable contacts (9) with the aid of one or more springs (8), in order to short circuit the CT secondary (3B), and further comprising a locking system (15) that selectively restrains the moveable contacts separated from the fixed contacts, even if the plug and receptacle are not connected.

2. The electrical circuit quick connection and disconnection system with automatic short circuit of current transformer secondaries according to claim 1, further comprising the plug (6) and receptacle (11) having a number N of paired poles (7, 12), with each pair of poles (7, 12) being connected to one of a plurality of CT secondaries (3B), therefore handling the connection of N CT secondaries (3B).

3. The electrical circuit quick connection and disconnection system with automatic short circuit of current transformer secondaries according to claim 2, comprising each pair of poles (7, 12) having a system that, under normal conditions of use, that is, with the plug (6) and receptacle (11) connected, allows the normal passage of current from the CT secondary (3B) to the load (14) connected to the latter, without short-circuiting the CT secondary (3B).

4. The electrical circuit quick connection and disconnection system with automatic short circuit of current transformer secondaries according to claim 1, wherein upon initiating the mechanical disconnection between the plug (6) and the receptacle (11), however with the electrical connection between the plug (6) and the receptacle (11) still present, the CT secondary (3B) is automatically short-circuited before the circuit is interrupted; continuing with the mechanical disconnection, the electric connection between plug (6) and receptacle (11) is interrupted.

5. The electrical circuit quick connection and disconnection system with automatic short circuit of current transformer secondaries according to claim 4, wherein once the plug (6) and receptacle (11) are mechanically and electrically disconnected, the moveable contacts (9) are pushed against the fixed contacts (10) by one or more springs (8), so as to short-circuit the CT secondary (3B).

6. The electrical circuit quick connection and disconnection system with automatic short circuit of current transformer secondaries according to claim 4, wherein upon initiating the mechanical disconnection, although still incomplete, between the plug (6) and the receptacle(11), the male poles (7) already make electrical contact with the female poles (12), while the moveable contact (9) continues to touch the fixed contact (10) due to the strength of the spring (8) so as to maintain the CT secondary (3B) short-circuited.

7. The electrical circuit quick connection and disconnection system with automatic short circuit of current transformer secondaries according to claim 4, wherein once the mechanical connection of the plug (6) and receptacle (11) is completed, the male poles (7) of the plug (6) are totally inserted and electrically connected to the female poles (12) of the receptacle (11) and the receptacle (11) pin (13) has pushed the moveable contact (9) so as to separate it from the fixed contact (10), having overcome the tension of the spring (8) and removing the short-circuit of the CT secondary (3B), allowing the current from the CT secondary (3B) to flow in the direction of the load (14).

8. The electrical circuit quick connection and disconnection system with automatic short circuit of current transformer secondaries according to claim 4, wherein being the plug (6) and the receptacle (11) completely connected, upon initiating the mechanical disconnection between the plug (6) and the receptacle (11), however with the male poles (7) and female poles (12) still being electrically connected, the receptacle (11) pin (13) has already been removed front the plug (6), so that the CT secondary (3B) has already been short-circuited by the moveable contact (9) that touches the fixed contact (10) pushed by the strength of the spring (8).

9. The electrical circuit quick connection and disconnection system with automatic short circuit of current transformer secondaries according to claim 4, wherein upon completion of the disconnection between the plug (6) and the receptacle (11) the CT secondary (3B) remains short-circuited, although the male (7) and female (12) poles are electrically disconnected and the secondary current (5) is no longer crossing the load.

10. The electrical circuit quick connection and disconnection system with automatic short circuit of current transformer secondaries according to claim 1, further comprising a visual indicator (16) that warns the user that the short-circuit contacts are open.

11. The electrical circuit quick connection and disconnection system with automatic short circuit of current transformer secondaries according to claim 10, wherein the visual indicator (16) is mechanically fixed to the moveable contact (9), so as to remain hidden inside the plug (6) when the CT secondary (3B) is short-circuited and to appear on the outside the plug (6) when the CT secondary (3B) is not short-circuited.

12. An electrical circuit quick connection and disconnection system for use with current transformer secondaries, the system comprising:

a plug electrically connected to a current transformer secondary circuit, the plug including a pair of plug poles, each plug pole including a fixed contact;

a receptacle electrically connected to a load, the receptacle including a pair of receptacle poles for mating engagement with the pair of plug poles;

a movable contact in the plug normally urged into contact with the fixed contacts to short circuit the current transformer secondary circuit across the plug poles;

a pin extending from the receptacle such that as the plug poles are brought into mating engagement with the receptacle poles, the pin pushes against the movable contact to break the short circuit without incurring any temporary opening of the transformer secondary circuit; and a locking system to selectively maintain the movable contact apart from the fixed contacts, even if the plug and receptacle are not connected.

13. The electrical circuit quick connection and disconnection system of claim 12 further comprising a protrusion extending from the movable contact, the protrusion being contained within the plug when the movable contact is in contact with the fixed contacts, the protrusion extending outside the plug when the movable contact is pushed away from the fixed contacts to give a visual indication that the plug poles are not short circuited.

14. The electrical circuit quick connection and disconnection system of claim 12, wherein, the plug poles are male and the receptacle poles are female.

* * * * *